US006699362B1

(12) United States Patent
Rautiainen

(10) Patent No.: US 6,699,362 B1
(45) Date of Patent: Mar. 2, 2004

(54) METHOD FOR THE MANUFACTURE OF PAPER, AND PAPER MACHINE LINE

(75) Inventor: Pentti Rautiainen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/019,865

(22) PCT Filed: May 10, 2000

(86) PCT No.: PCT/FI00/00419

§ 371 (c)(1),
(2), (4) Date: Apr. 15, 2002

(87) PCT Pub. No.: WO00/70144

PCT Pub. Date: Nov. 23, 2000

(30) Foreign Application Priority Data

May 12, 1999 (FI) ..... 991096

(51) Int. Cl.[7] ..... D21F 9/02

(52) U.S. Cl. ..... 162/136; 162/205; 162/125; 162/358.1; 162/358.2; 162/358.3; 162/361

(58) Field of Search ..... 162/136, 205, 162/125, 265, 123, 358.1, 358.2, 358.3, 360.2, 361, 184, 137, 135, 206

(56) References Cited

U.S. PATENT DOCUMENTS

| | | | | |
|---|---|---|---|---|
| 5,087,325 A | | 2/1992 | Page | |
| 5,416,980 A | | 5/1995 | Ilvespää | |
| 5,438,920 A | | 8/1995 | Koivukunnas et al. | |
| 5,685,909 A | | 11/1997 | Reich et al. | |
| 5,894,679 A | | 4/1999 | Kukhasalo et al. | |
| 5,916,420 A | * | 6/1999 | Wurster et al. | 162/137 |
| 6,001,421 A | | 12/1999 | Ahonen et al. | |
| 6,038,789 A | | 3/2000 | Kaihovirta et al. | |
| 6,267,845 B1 | | 7/2001 | Hautala et al. | |
| 6,270,624 B1 | | 8/2001 | Huovila et al. | |
| 6,413,371 B1 | * | 7/2002 | Ahonen et al. | 162/136 |

FOREIGN PATENT DOCUMENTS

| | | |
|---|---|---|
| CA | 2114464 A1 | 7/1994 |
| EP | 0 427 887 A1 | 11/1989 |
| EP | 0 651 092 B1 | 10/1994 |
| EP | 0 726 353 A2 | 11/1995 |
| EP | 0 824 157 A3 | 7/1997 |
| FI | 91900 | 5/1994 |
| FI | 92729 | 9/1994 |
| FI | 96334 | 2/1996 |
| FI | 960925 | 2/1996 |

(List continued on next page.)

OTHER PUBLICATIONS

"Ein neuer Ansatz für das Management der Nasspartie" transcription of a lecture by T. Pekkarinen and A. Kaunonen which appeared in Wochenblatt für Papierfabrikation, vol. 19, No. 20, Oct. 1998, pp. 984–988.

(List continued on next page.)

*Primary Examiner*—Steven P. Griffin
*Assistant Examiner*—Mark Halpern
(74) *Attorney, Agent, or Firm*—Stiennon & Stiennon

(57) ABSTRACT

Fine paper is manufactured in a paper machine by feeding stock into a headbox (100) from a short circulation the stock volume of which has been minimized, water is removed from the paper web (W) most advantageously in a gap former (250), in the press section (300) water is pressed out of the paper web (W) in an extended nip press (360), in the dryer section (400) impingement drying (450) is employed for the drying of the paper web (W), the paper web (W) is pre-calendered in a calender (900) employing low nip loads, both surfaces of the paper web (W) are precoated at the same time, after precoating (500) the paper web (W) is dried by means of contact-free drying (660), the paper web (W) is coated in an on-line coating station/stations (700, 800), after which the paper web (W) is at least partly dried in a drying section/sections (750, 850) by means of contact-free drying of the paper web (W), and the paper web (W) is calendered in an on-line calender (900) while the linear load in each nip is regulated separately.

34 Claims, 1 Drawing Sheet

FOREIGN PATENT DOCUMENTS

| | | | |
|---|---|---|---|
| FI | 98387 | | 2/1997 |
| FI | 99155 | | 6/1997 |
| FI | 101489 | B | 6/1998 |
| FI | 981327 | | 6/1998 |
| FI | 981330 | | 6/1998 |
| FI | 981331 | | 6/1998 |
| FI | 105935 | B | 10/2000 |
| FI | 106271 | B | 12/2000 |
| WO | WO 95/14816 | | 6/1995 |
| WO | WO 95/30049 | | 11/1995 |
| WO | WO 99/32714 | | 7/1999 |
| WO | WO 99/55966 | | 11/1999 |
| WO | WO 99/64671 | | 12/1999 |
| WO | WO 99/64672 | | 12/1999 |

OTHER PUBLICATIONS

"Efficient Forming at High Speeds" by Lauri Verkasalo, XI Valmet Paper Technology Days, 1998.

"Multilayering, Method or Madness?" by Michael H. Odell and Juha S. Kinnunen, XI Valmet Paper Technology Days, 1998.

"Challenges for Digital Printing Papers" by Pasi Ahonen, XI Valmet Paper Technology Days, 1998.

"Influence of Base Paper Filler Content and Pre–calendering on Metered Film Press Coating—Part I: A Coating Process Study" by Johan Grön and Jaana Ahlroos, lecture from the 1998 Tappi Proceedings Coating/Papermaking Conference Book 2 May 4–6, 1998 Sheraton New Orleans, New Orleans, LA.

U.S. patent application No. 08/467,780, Method for Producing Surface–Treated Paper and Dry End of a Paper Machine Filed Aug. 8, 1995; Abandoned Apr. 25, 1997.

* cited by examiner

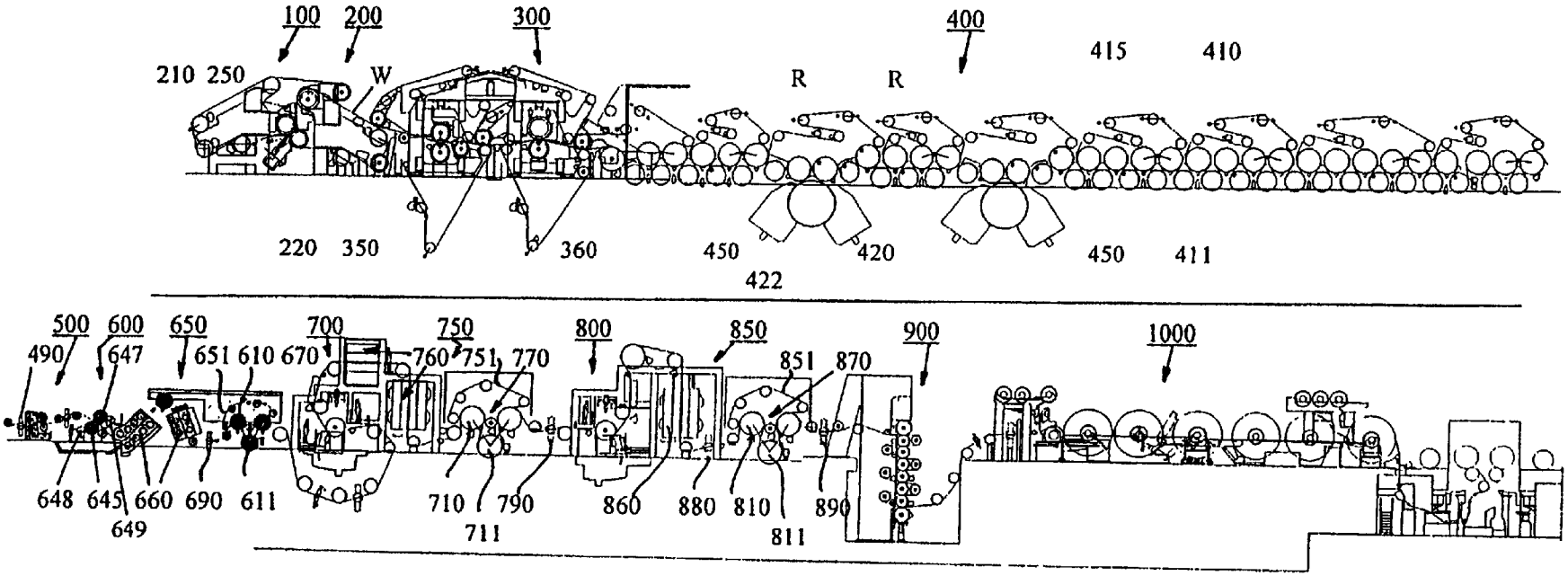
FIG.

METHOD FOR THE MANUFACTURE OF PAPER, AND PAPER MACHINE LINE

CROSS REFERENCES TO RELATED APPLICATIONS

This application is a U.S. national stage application of PCT Application No. PCT/FI00/00419, filed May 10, 2000, and claims priority on Finnish Application No.991096, filed May 12, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for the manufacture of paper, in particular of fine paper, and to paper machine lines therefor.

In this description, by fine paper is meant uncoated fine paper and coated fine paper. The basis weight of uncoated fine paper is usually 40 to 230 g/m$^2$, that of coated fine paper 60 to 250 g/m$^2$. Typical pulp for the manufacture of fine paper comprises chemical fibres: short fibres which are obtained, for example, from birch and eucalyptus, and a long-fibre material obtained from softwood trees is generally added to this. The proportion of mechanical pulp is generally below 10%. About 15 to 30% of filler is added to the pulp, and the filler may be calcium carbonate, kaolin and/or other suitable mineral pigments. Recently, in the manufacture of fine paper, increasing use has also been made of recycled fibres.

The essential quality properties of coated woodfree fine paper include gloss, smoothness, bulk, opacity, and brightness, typically:

gloss is >70% (Hunter), smoothness $PPS_{10}$<1.1, bulk >0.8 cm$^3$/g opacity >92%, and brightness >80%.

However, all of these quality values are seldom achieved at the same time on fine paper machines according to the state of the art.

In paper or board machines known in prior art, the short circulation and other stock systems are most commonly built such as to mix fibres, fillers, fines and additives to form a stock that is as homogeneous as possible in order to be supplied into a headbox of a paper machine. In multi-layer web forming, it is also known to use several different stock systems for feeding different fibre suspensions into the headbox. In prior art there are also known a short circulation and a headbox allowing layering of additives, fillers and/or fines. One stock feed arrangement of this kind advantageously applied in the invention is disclosed in FI patent application 934793. Fillers, fines and additives can also be supplied only in the headbox itself. One arrangement of this kind is described in EP patent publication 0 824157.

Quite recently, a novel type of short circulation arrangement has been developed, marketed by Metso Paper, Inc. under the trademark OptiFeed™, which is described, among other things, in the magazine article *Ein Neuer Ansatz für das Management der Nasspartie, Wochenblatt für Papierfabrikation*, vol. 19, No. 20, October 1998. By using the OptiFeed™ arrangement, the stock volumes of the short circulation are minimized, which enables, among other things, a quick grade change.

The headbox spreads the formed pulp suspension evenly onto a wire section, in which dewatering and couching of the web begin. In prior art there are known several different types of wire sections, or formers, known in themselves to a person skilled in the art; fourdrinier formers, hybrid formers, and gap formers. In recent years, in the manufacture of fine paper, a gap former has become common in which a slice jet produced by a headbox is fed between two wires and the bulk of the water is removed between said wires in two directions. One advantageous gap former arrangement has been described in the paper read by L. Verkasalo: *Efficient Forming at High Speeds, XI Valmet Paper Technology Days* 1998. In the arrangements known in prior art, the fibre and filler distribution in the thickness direction of the web can be controlled to a limited degree, for example, by means of placement and vacuums of the dewatering elements of the former. The fillers often accumulate on the surfaces of the web in dewatering stages.

In prior art there are also known multi-layer headboxes, one of them having been described, for example, in the paper read by M. Odell: *Multilayering, Method or Madness?, XI Valmet Paper Technology Days* 1998 and in FI patent 92 729, and one of them having also been described in the paper read by P. Ahonen: *Challenges for Digital Printing Paper, XI Valmet Paper Technology Days* 1998. Multi-layer headboxes allow desired layer structures to be produced in the web by feeding stock in layers between wires.

The web is passed from the wire section to a press section where water is removed from the web by pressing it against one or two felts. A skilled person knows several different press arrangements from prior art, for example, a press based on roll nips, marketed by Metso Paper, Inc. under the trademark SymPress II™. Recently, instead of roll nips, in the case of all paper and board grades ever-increasing use has been made of an extended nip known in itself in prior art because of its higher dewatering capacity and/or its ability to retain the bulk of the web.

The dryer section in fine paper machines known in prior art has most commonly been formed of a dryer section which uses conventional single- and/or twin-wire draw and in which drying takes place mainly as cylinder drying while the wire presses the web against a heated cylinder surface. At high running speeds, single-wire draw through the entire dryer section has become common in recent years. As the most recent arrangement, for example, the patent application PCT/FI98/00945 has proposed combining impingement drying with cylinder drying in order to provide a higher evaporation rate and a shorter dryer section.

In several fine paper machines known in prior art, the paper web is passed from the dryer section to a precalender, which in known arrangements may be a calender with hard or soft nips, in which the paper web is passed through the nip between rolls to provide smoothness to the surface of the paper web. Recently, also in the case of fine paper, a so-called soft calender has become common which comprises a soft coated roll and a hot hard-faced thermo roll. In the precalender, loose fibres and other stock components are also fixed to the surface of the web, but, at the same time, differences in density may also be caused in the base paper and some of the bulkiness of the web important to many grades may be lost.

After that, in the fine paper machines known in prior art there is precoating, for example, a surface sizing or pigmenting unit. In surface sizing, the surfaces of the web are treated with a starch or pigment solution in a film size press, for example, by means of an applicator device marketed by Metso Paper, Inc. under the trademark SymSizer™. Surface sizing, pigmenting, or coating is performed at this stage typically on both sides of the web at the same time, but the surfaces of the web can also be treated separately in successive units. After that, the paper web is dried by using infrared dryers and airborne web-dryers as well as a subsequent cylinder group or groups, and the paper web is reeled by means of a machine reel-up.

After that, in the manufacturing process of fine paper according to prior art there is an unwind stand, from which the web is passed to an off-machine coating station. Different coating devices are known in prior art, such as, for example, coating devices of the blade coating, jet, film transfer or spray type. A coating agent is transferred by means of the coating device freely to the surface of the web either as a continuous jet (jet) or as drops (spray) or the coating agent is applied by a roll. In one known arrangement, one side of the paper web is precoated first, after which there is a dryer section, and after that the other side of the paper web is precoated, which is followed by a dryer section. The coating of the thus produced precoated web is completed by coating it with other coating layers and, after that, the web is dried, and wound up. The dryer part of the coating station typically comprises first a unit which is not in contact with the web, for example, an infrared dryer, and a cylinder group located after that. In the end, the web is unwound and calendered by means of a supercalender, which imparts a desired level of smoothness and gloss to the web. Reeling ends the fine paper machine line. One reel-up known in prior art is the reel-up marketed by Metso Paper, Inc. under the trademark OptiReel™.

With respect to the prior art related to the invention, reference is also made to the Metso Paper, Inc.'s FI patent applications 981330 and 981331. In these, FI patent application 981330 discloses an integrated paper machine by which paper of good quality can be manufactured with high efficiency at a speed exceeding 2000 m/min, and which is shorter than present paper machines.

FI patent application 981331 discloses a paper machine which is intended in particular for the manufacture of paper which has copy paper properties as well as high gloss and suitable porosity for colour powder printing.

One problem in the fine paper machines known in prior art is particularly their space requirement because of the long machine, and the fact that the change of grade takes a long time. For example, when a conventional short circulation is used, the change of grade takes about two hours. Moreover, when cylinder drying is used, because of the high heat capacity of the cylinders, the changing of heating power is a slow process.

SUMMARY OF THE INVENTION

An object of the invention is to provide a method and a paper machine for fine paper, in particular for CWF fine paper, i.e. coated woodfree (Coated Wood Free) fine paper, in which operations take place on-line. The invention is also suitable for use in the manufacture of uncoated woodfree fine paper (UCWF, UnCoated Wood Free).

An object of the invention is to provide a method and a paper machine for the manufacture of fine paper in which the change of grade is fast. The fast change of grade allows short delivery times so that different paper grades can be delivered to customers just at the right time.

Furthermore, an object of the invention is to provide a method and a paper machine for the manufacture of fine paper allowing different profile control arrangements.

In connection with the invention, it shall be particularly noted that several of the techniques used in the method and in the paper machine in accordance with the invention have become known separately only quite recently in connection with different paper or board grades. In this invention, the inventor has realized the possibility of assembling from the new technologies a fine paper machine line which produces high-quality fine paper with good efficiency.

In accordance with the invention, the fine paper manufacturing line is constructed in an integrated manner. The invention uses most advantageously a short circulation arrangement marketed by the Metso Paper, Inc. under the trademark OptiFeed™ or a similar type of short circulation arrangement, one of them being described in FI patent application No. 981327, in which the dilution of component stocks to a metering consistency takes place before the stock chests of the component stocks, the regulation of the basis weight takes place from the stock chests of the component stocks by means of regulation of the flows of the component stocks, and the dilution to the headbox consistency takes place in two stages, of which the first one has an invariable flow, and in the second stage the flow is regulated by means of a control signal received from the headbox pressure regulation. This kind of short circulation, in which the volume of the short circulation has been minimized, enables a fast grade change because it uses little stock and extra mixing stages have been omitted from it. Moreover, in such a short circulation process an abundance of automation is used, which further contributes to the fact that the change of grade can be shortened from an hour to a few tens of seconds. For example, a 15% change of the basis weight takes a few tens of minutes when applying a conventional short circulation, while it is shortened to a few tens of seconds when using an arrangement of the OptiFeed™ type.

As the headbox the invention uses the headbox marketed by Metso Paper, Inc. under the trademark OptiFlo™ or a similar type of headbox, in which the basis weight profile can be controlled by consistency adjustment and the fibre orientation can be affected by adjusting the profile. In the headbox, it is possible to use layering, layering of additives or fillers, in respect of which reference may be made, for example, to the Metso Paper, Inc.'s EP patent 651 092.

As the former is used a gap former which allows higher speeds than other types of formers and carries out dewatering on two sides, whereby symmetric paper is obtained. As one gap former of this kind may be mentioned, for example, the wire section marketed by Metso Paper, Inc. under the trademark OptiFormer™ or a similar type of former, one of them having been described, among other things, in the paper read by L. Verkasalo: *Efficient Forming at High Speeds, XI Valmet Paper Technology Days* 1998.

The fine paper manufacturing line according to the invention makes use of extended nip pressing. A so-called shoe press provides good bulk and high dry solids and the lowest possible asymmetry in the web. When using, for example, Metso Paper, Inc.'s double-felted OptiPress™ press section, symmetric dewatering and a web having symmetric surface properties are achieved. When it is desirable to achieve high dry solids, it may be beneficial to replace one felt with a non-water-receiving fabric which transfers the web well, with a so-called transfer belt.

In the invention, the dryer section employs both cylinder and impingement drying, one of such dryer sections being described, for example, in the international patent application PCT/FI98/00945. Advantageously, for example, a dryer section marketed by Metso Paper, Inc. under the trademark OptiDry™ or a similar type of dryer section is used. In such a dryer section where impingement drying is used in addition to cylinder drying, the change of grade is quick because it takes considerably less time to change impingement drying parameters than to change the temperature of massive drying cylinders. Impingement drying also allows more efficient control of the moisture profile than conventional cylinder drying alone.

When desired, precalendering can be used in the dryer section, such precalendering being described, for example, in FI patent application 960925, which discloses calendering against a drying cylinder. Precalendering can also be performed between two rolls. Naturally, when needed, precalendering can also be carried out in a traditional manner after the dryer section. In that connection, the calender is either a hard nip calender or a soft calender. An extended nip calender can also be utilized advantageously in the arrangement according to the invention. Irrespective of where the precalender is located, relatively low loads, for example, below 80 kN/m are used in calendering in accordance with the invention. By this means, one important property of fine paper, bulk, can be conserved. On the other hand, the wet end of the fine paper machine according to the invention, which makes symmetric paper, allows low linear loads in the calender.

In the fine paper machine line in accordance with the invention, precalendering is followed by precoating. The function of precoating is to make the pores present in the surface structure of the base paper smaller in a suitable manner in order that the surface coating proper shall remain on the surface and shall not be absorbed into the structure of paper. In the precalendering, a surface sizing/pigmenting unit marketed by Metso Paper, Inc. under the trademark SymSizer™ or OptiSizer™ or a similar type of unit is used which allows profile control of the amount of surface size/pigment.

The precoating is followed by a dryer section mainly applying contact-free drying, which allows a fast grade change. The contact-free drying is followed by a short cylinder group which in itself serves to affect primarily the stabilization of the travel of the web, the draw and tension of the web while the drying process is continued at the same time. The cylinder group may comprise single-wire or twin-wire draw, however, most advantageously single-wire draw. In connection with the contact-free drying, it is possible to use a drying arrangement marketed by Metso Paper, Inc. under the trademark TurnDry™ or a similar type of drying in which the paper web is dried and turned by means of the same device, for example, by means of a combination of a turning device and an airborne web-dryer. This enables a fast grade change and, at the same time, assures stable running of the web.

A suitable coating station, for example, a blade coater, a coating device of the jet or spray type is used in the coating process. In the invention, a coating agent is transferred freely by means of the coating device to the surface of the web either as a continuous jet (jet) or as drops (spray). Advantageously, a coating device marketed by Metso Paper, Inc. under the trademark OptiCoat Jet™ or a corresponding type of coating device is used.

In order to eliminate web breaks, the web may be coated while supported by a belt. Supported coating is described, for example, in Metso Paper, Inc.'s Finnish patent FI 101489 as well as in the article 1998 *Coating/Paper Machine Makers Conference, TAPPI Proceedings.*

The drying after coating is started as contact-free drying, for example, by means of a dryer marketed by Metso Paper, Inc. under the trademark PowerDry™ or by means of an equivalent type of dryer, which provides a high drying capacity and, when needed, a quick change of drying capacity. In actual fact, contact-free drying is often the principal form of drying so that the short cylinder group following after it functions mainly as a drive group. The drying stages after surface sizing and/or coating are advantageously provided with a profile control device, whereby the profile control of the drying of the paper web in after-drying stages is possible. Some drying section of the fine paper machine line in accordance with the invention can also be provided, for example, with steam-treatment or moistening devices known in prior art with a view to controlling and adjusting the curl of the paper web.

After that, there is an on-line multi-nip calender, for example, a calender marketed by Metso Paper, Inc. under the trademark OptiLoad™ or a corresponding type of calender, which differs from conventional supercalenders in that its linear loads in each nip can be regulated separately. By this means, it is possible to conserve bulk, yet attaining good gloss and smoothness. With respect to this type of calender, reference is made to FI patent 96334.

The fine paper machine line according to the invention ends in a reel-up. It is most preferably a reel-up marketed by Metso Paper, Inc. under the trademark OptiReel™ or the type of reel-up which produces low amounts of bottom broke and provides a roll of a high standard to ensure its problem-free further processing.

Suitable automatic and measuring devices are incorporated into the method and the paper machine for manufacturing fine paper in accordance with the invention, for example, for the purpose of determining and correcting longitudinal and cross direction profiles of the web or for the purpose of performing a fast grade change. As a measuring device is used, for example, a transverse beam which comprises several sensors or scanners and, at the same time, it is possible to measure machine direction variation, for example, by means of scanning devices.

By way of summary it may be stated that the invention has succeeded in combining in the same concept those essential factors of the fine paper manufacturing line by means of which a high paper quality and a fast grade change can be achieved. These factors include in particular the use of a short circulation which enables a fast grade change and the use of a gap former as a former which allows higher speeds than other types of formers and makes it possible to perform dewatering on two sides, whereby symmetric paper is obtained. Moreover, the double-felted shoe press advantageously used in the invention provides good bulk and high dry solids as well as the lowest possible asymmetry in the web. In the dryer section, at least part of the dryer section is formed of impingement drying, which enables a fast grade change. The calender uses low nip loads and both surfaces are treated at the same time in the surface sizing/pigmenting stage. Cylinder drying and non-web-contacting drying are combined in an after-dryer section, which contributes to enabling a fast grade change. Paper is treated on both sides in surface treatment units, which is followed by a dryer section comprising mainly contact-free drying. The calender is an on-line multi-nip calender in which the linear loads in each nip can be regulated separately. By this means, a desired gloss and smoothness level is achieved while still retaining bulk.

In the invention, the possibility of profile control is ensured by the fact that profiling devices are used as devices. The basis weight can be profiled by adjusting the consistency in the headbox. In the press section, a steam box can be used for increasing and profile control of dry solids. Impingement drying allows profile control of drying. In the dryer section it is also possible to use a moistening device for profile control of dry solids, and in sizer types of coaters surface size/the amount of coating can be profiled. It is easy to combine profile control with non-web-contacting drying and, when needed, before the calender it is possible to use, for example, a moistening device which is based on steam or water mist and by means of which it is possible to control the moisture profile of the web and affect its curl.

In connection with the invention, control of the curl of the paper web can be used, in which respect reference is made to FI applications 906216, 950434, 964830 and 972080.

In the following, the invention will be described in more detail with reference to the figure in the accompanying drawing, to the details of which the invention is, however, not by any means intended to be narrowly confined, nor is the invention intended to be limited only to this embodiment which is advantageous in itself.

BRIEF DESCRIPTION OF THE DRAWINGS

The FIGURE schematically shows one application of the paper machine in accordance with the invention. It does not show the short circulation or other stock arrangements of the fine paper machine in accordance with the invention. In respect of them, reference is made to the magazine article mentioned previously *Ein Neuer Ansatz für das Management der Nasspartie, Wochenblatt für Papierfabrikation, vol.* 19, No. 20, October 1998 and to patent application FI 981327.

DESCRIPTION OF THE PREFERRED EMBODIMENTS

As shown in the FIGURE, stock is fed from a headbox 100 to a wire section 200, in which there is a gap former 250 which drains water on two sides. In a press section 300, at least one press nip is an extended nip press. In the press of the FIGURE, a first nip 350 is a roll nip and a second nip 360 is an extended nip, advantageously a shoe press, which conserves bulk and reduces two-sidedness in dewatering of paper. The web W is passed from the press section 300 to a forward dryer section 400, in which single-wire draw groups R and impingement drying 450 are used in the application illustrated in the FIGURE. In the application shown in the FIGURE, the impingement drying units 450 are formed of a large-diameter cylinder 420 placed in a basement space and of an impingement drying apparatus 422 placed in connection therewith. The forward dryer section 400 is followed by a measurement frame 490, among other things, for measuring cross profiles of the web. In the example of the FIGURE, a calender 500 is a soft calender. It is followed by a precoating station 600 based on film transfer applying roll application for surface sizing/pigmenting of the web, and by an after-dryer section 650, which is composed of a section 660 mainly applying contact-free drying (infrared drying, airborne web-drying) and of a short cylinder group 670. After that, the web is coated in coating stations 700,800, in which one side of the web is first coated in the first coating station 700, which side is dried in a dryer unit 750 mainly using contact-free drying 760, after which there is a short cylinder group 770. The other side of the web is coated in the second coating station 800, which is followed by a dryer section 850 which mainly applies contact-free drying 860, after which there is a short cylinder group 870. This is followed by a calender in which the paper web is calendered so as to have desired gloss and smoothness in a multi-nip calender 900, in which the loading pressure in each nip can advantageously be regulated separately. Finally, the web is reeled into rolls by means of a reel-up 1000.

In the paper machine shown in the FIGURE, the travel of the paper web W is as follows. The stock is fed from the headbox 100 into a gap between forming rolls 210, 220 of the gap former 250 of the wire section 200, from which it is passed between wires via the dewatering devices of the gap former 250 further to the press section 300 while supported by a wire. The press section 300 comprises two presses 350 and 360. The web W is passed on an upper fabric of the first press, while supported by a lower fabric, so as to be between the press rolls of the press 350. From the lower fabric, the web W is passed onto an upper fabric of the next press 360 and further between the upper fabric and a lower fabric so as to be between the press rolls of the press 360. The web W is passed from the press section 300 to the dryer section 400, in which the web W is dried, while supported by drying wires, in the impingement drying groups 450 and in the drying groups R that apply single-wire draw. In the drying groups R applying single-wire draw, the reference numeral 415 designates the drying wire and the reference numeral 410 designates heated drying cylinders in an upper row and the reference numeral 411 designates reversing cylinders or rolls in a lower row. The web W runs meandering from the reversing cylinders/rolls 411 of the lower row onto the heated drying cylinders 410 of the upper row, on which the web W is in direct contact with the heated cylinder surface. For the sake of clarity, the above-noted signs have been indicated only in connection with one drying group. After that, the web W is passed via the measurement device 490 to the calender 500. Rolls of the precoating unit 600 are denoted with the reference numerals 645 and 647 and the reference numerals 648 and 649 designate film transfer equipment of the precoating unit. The web W is passed through a first contact-free drying and turning device 660 via a second contact-free drying device, for example, an infrared/airborne web-dryer 660 to the drying group 670 which applies single-wire draw and which comprises a drying wire 651 and heated drying cylinders 610 as well as reversing cylinders/rolls 611. After that, the web is coated in the coating stations 700, 800, in which the web is passed from the coating station 700, 800 into the drying equipment 760, 860 applying contact-free drying, said drying equipment being followed by the drying group 770, 870 applying single-wire draw and comprising a drying wire 751, 851, heated drying cylinders 710,810 and reversing cylinders/rolls 711,811. The precoating section 600 is followed by a measuring device 690 which is placed between the section 660 applying contact-free drying and the cylinder group 670. In addition, a measuring device 790, 890 is placed after each coating station 700, 800. Furthermore, a measuring device 880 is also placed in connection with the latter coating group before the cylinder group 870. After that, the web W is passed to the on-line multi-nip calender 900. After the calender 900, the web W is passed to the reel-up 1000, in which the paper web W is reeled into paper rolls.

Above, the invention has been described only with reference to one of its advantageous embodiment examples, to the details of which the invention is, however, not intended by any means to be narrowly confined. Many variations and modifications are feasible within the inventive idea defined in the following claims.

What is claimed is:

1. A method for the manufacture of paper, in which paper stock is fed from a headbox to a wire section in which water is drained from a paper web, in which method the paper web is passed from the wire section to a press section to press water out of the paper web, and in which method, after the press section, the paper web is dried in a dryer section, precalendered and precoated in a precoater, after which the paper web is dried in a drying section and coated in at least one coating station, after which the paper web is dried in at least one drying section, calendered in a calender, and reeled in a reel-up, wherein:

the stock is fed into the headbox from a short circulation the stock volume of which has been minimized;

in the wire section, water is drained from the paper web in a former;

in the press section, water is pressed out of the paper web in at least one extended nip press;

in the dryer section, at least part of the drying of the paper web is carried out by means of impingement drying;

the paper web is precalendered in a calender employing low nip loads;

both surfaces of the paper web are precoated at the same time;

after precoating, the paper web is dried by contact-free drying;

the paper web is coated in at least one on-line coating station, after which the paper web is at least partly dried in at least one drying section by contact-free drying of the paper web; and the paper web is calendered in an on-line calender while the linear load in each nip is regulated separately.

2. The method of claim 1 wherein the basis weight profile is controlled by consistency adjustment in the headbox in order to affect the fibre orientation of the paper web by controlling the profile.

3. The method of claim 1 wherein a shoe press is used as the extended nip press.

4. The method of claim 1 wherein two felts or a felt and a transfer belt are used in the press nips in the press section.

5. The method of claim 1 wherein the amount of surface size/pigment used in precoating is profiled.

6. The method of claim 1 wherein combinations of impingement drying and cylinder drying or non-web-contacting drying and cylinder drying are applied to the drying of paper in order to accomplish a fast grade change.

7. The method of claim 1 wherein, in connection with the contact-free drying carried out after precoating and coating, the drying of the paper web is profiled by a profiling device.

8. The method of claim 1 wherein a coating device of the blade, jet or spray type is used in the coating.

9. The method of claim 1 wherein the paper web is measured by sensors fixed to a transverse beam in order to monitor properties of the paper web, and that the profiling of the properties of the paper web is controlled based on the measurement results.

10. The method of claim 1 wherein the drying of the paper web in the dryer section is profiled by using impingement drying.

11. The method of claim 1 wherein a moistening device based on steam or water mist, placed before the calender, is used for profile control of curl.

12. The method of claim 1 wherein precalendering against a cylinder or a roll is used in the dryer section.

13. The method of claim 1 wherein the paper web is supported by belts in the end part of the paper machine.

14. The method of claim 1 wherein principal drying in the after-drying units is carried out without contact with the web.

15. The method of claim 1 wherein low linear loads are used in the precalender.

16. The method of claim 15 wherein the linear loads used in the precalender are below 80 kN/m.

17. The method of claim 1 wherein precalendering is carried out using an extended nip calender.

18. The method of claim 1 wherein fine paper is manufactured using layering of fibres and/or additives and/or fillers.

19. The method of claim 1 wherein the paper formed is fine paper.

20. The method of claim 1 wherein the former is a gap former.

21. A paper machine line comprising:

a short circulation, the stock volume of which has been minimized;

a headbox;

a wire section, comprising a former;

a press section, comprising at least one extended nip press;

a dryer section, at least part of which is based on impingement drying;

a precalender;

a precoater and a drying section after that;

a coating station/stations and after-drying section/sections;

a calender and a reel-up;

a paper web precoater which coats both sides of the paper web at the same time;

at least one on-line coating station;

at least one drying section substantially based on contact-free drying placed after said at least one on-line coating station; and an on-line calender in which the linear loads in each nip can be regulated separately.

22. The paper machine line of claim 21 wherein the paper machine is for the manufacture of fine paper.

23. The paper machine line of claim 21 wherein the on-line calender is a multi-nip calender.

24. The paper machine line of claim 21 wherein the headbox is a multi-layer headbox.

25. The paper machine line of claim 21 wherein the wire section is a gap former.

26. The paper machine line of claim 21 wherein a latter nip of the press section is an extended nip press.

27. The paper machine line of claim 21 wherein in the press nips of the press section there are two felts or a felt and a transfer belt.

28. The paper machine line of claim 21 wherein the coater is a coating device of the blade, jet or spray type.

29. The paper machine line of claim 21 wherein its drying sections comprise as a combination both cylinder drying and impingement drying or cylinder drying and non-web-contacting drying.

30. The paper machine line of claim 21 wherein the after-drying sections are dimensioned so that principal drying takes place without contact with the web.

31. The paper machine line of claim 21 wherein the paper machine line comprises a moistening device based on steam or water mist, placed before the calender, for profile control of curl.

32. The paper machine line of claim 21 wherein the drying section comprises a precalendering device placed against a cylinder or a roll.

33. The paper machine line of claim 21 wherein the paper machine has an end part which comprises belt support of the paper web.

34. The paper machine line of claim 21 wherein the precalender of the paper machine line is a soft or extended nip calender.

* * * * *